United States Patent [19]

Steverlynck

[11] 4,044,802

[45] Aug. 30, 1977

[54] MECHANICAL MULTIPLIER FOR WEAVING LOOMS

[75] Inventor: Patrick A. Steverlynck, Vichte, Belgium

[73] Assignee: N. V. Weefautomaten Picanol, Ieper, Belgium

[21] Appl. No.: 720,593

[22] Filed: Sept. 7, 1976

[30] Foreign Application Priority Data

Sept. 19, 1975 Netherlands ..... 7511118

[51] Int. Cl.[2] ..... D03D 47/00

[52] U.S. Cl. ..... 139/449; 74/25

[58] Field of Search ..... 139/449, 55 R, 55.1; 74/25, 99 R, 110

[56] References Cited

U.S. PATENT DOCUMENTS

| | | | |
|---|---|---|---|
| 3,859,862 | 1/1975 | Brems | 74/25 |
| 3,888,272 | 6/1975 | Larsson | 139/449 |

FOREIGN PATENT DOCUMENTS

| | | | |
|---|---|---|---|
| 1,407,632 | 9/1975 | United Kingdom | 139/449 |

*Primary Examiner*—James Kee Chi

*Attorney, Agent, or Firm*—Bacon & Thomas

[57] ABSTRACT

The present invention concerns a mechanical multiplier for weaving looms, for instance for the drive of rapiers or lances, of the head frames or such like.

4 Claims, 3 Drawing Figures

MECHANICAL MULTIPLIER FOR WEAVING LOOMS

Several devices have already been suggested for driving the grippers of rapier looms. In some of these devices, the grippers are attached each to the end of a flexible lance or strip, whereby these lances and grippers are displaced synchronously in a reciprocating movement.

Considering that these grippers have each time to travel over a relatively large distance, at as high a speed as possible, and such in complete synchronism with the movements of the other parts of the loom, the problem of the drive for aforesaid lances is not without difficulty, all the more so as the driving device must occupy as small a space as possible.

The purpose of the invention is to offer a solution to the above-described problem.

Consequently, a mechanical multiplier is suggested, which consists mainly of the combination of a driven rocker lever, a gear which engages the part to be driven, a pinion which is solidly attached to aforesaid gear, and a flexible element such as a belt, a chain or suchlike, which engages aforesaid pinion, which passes over two rollers fitted at one end of aforesaid rocker lever, and of which both ends are attached to fixed points of the device.

Such a device can be fitted at one end of the slay of a weaving loom. When two rapiers or lances are used, with transfer of the weft thread from one gripper to the other at the center of the slay, two devices according to the invention are used, one at each side of the slay.

The advantages of the driving device according to the invention are mainly : a very simple and sturdy construction; a relatively light weight; low inertia and a limited space requirement due to the small amplitude of the movement of aforesaid rocker lever.

In order to show the characteristics of the invention more clearly, a preferred form of embodiment shall be described hereinafter in greater detail, with reference to the appended drawings in which.

Figure 1:
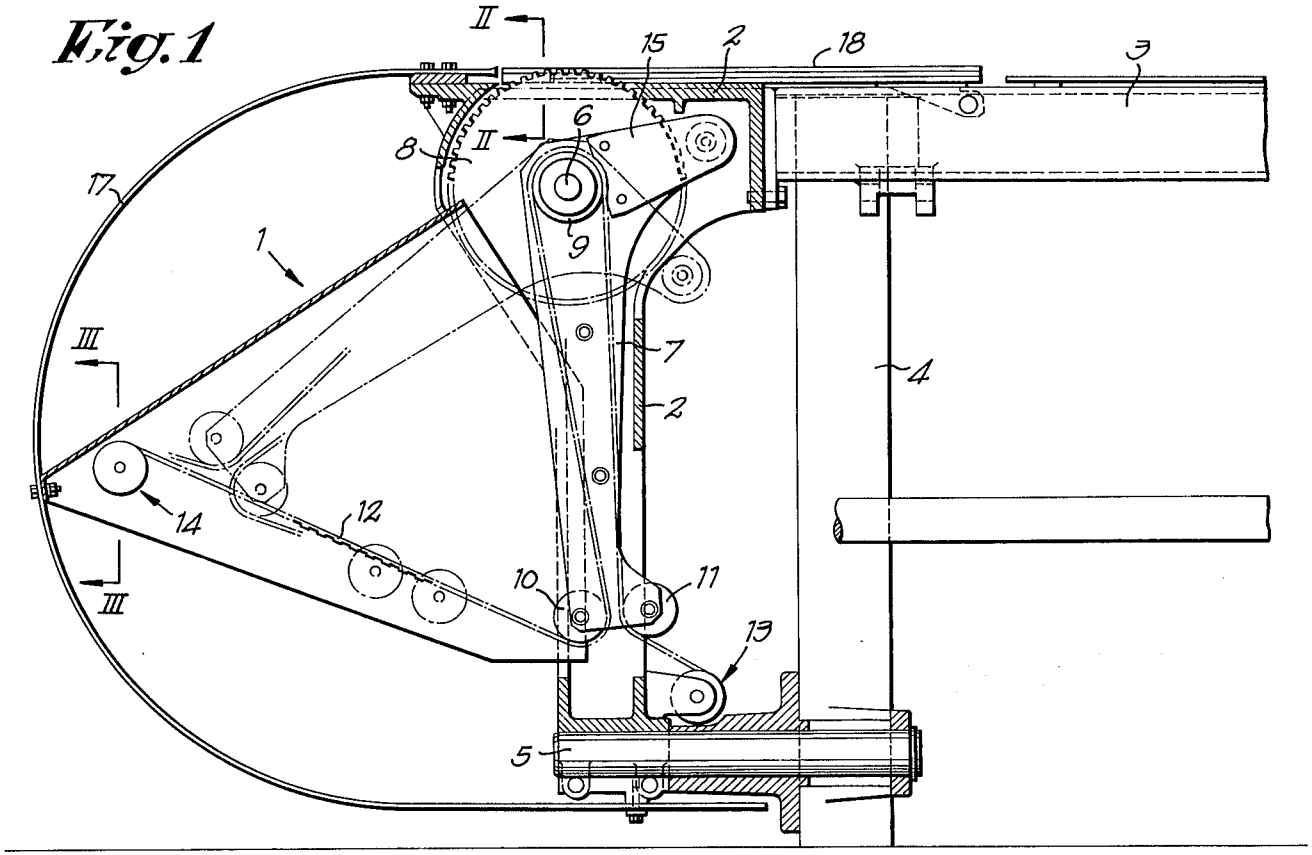
FIG. 1 is a side view and partial section of a device according to the invention.

As shown in FIG. 1, the device 1 according to the invention is fitted in a casing 2 which is attached to one end of the slay 3, at the level of the slay sword 4, and is fitted rotatably around the shaft 5 of the slay.

In casing 2, a shaft 6 is provided, upon which are rotatably fitted a rocker level 7, on the one hand, and a gear 8 with pinion 9, on the other hand.

On the end of rocker lever 7, which is furthest removed from shaft 6, two guiding rollers or wheels 10 and 11 are rotatably fitted.

A flexible element 12, such as a chain, a toothed belt or suchlike, is attached at one of its ends to a fixed post 13 of the device and is then led over rollers 11, pinion 9 and roller 10, whereby its other end is attached to a further fixed post 14 of the device.

The rocker lever 7 is provided with a laterally protruding arm 15 which is connected to driving means which are not shown, whereby lever 7 is alternately rotated from one of its end positions (full line in FIG. 1) to the other (dash-dot line in FIG. 1).

Figure 2:
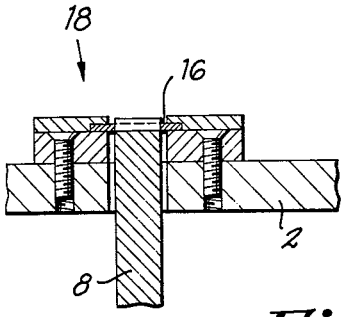
FIG. 2 and FIG. 3 are cross sections respectively according to lines II-II and III-III in FIG. 1.
Figure 3:
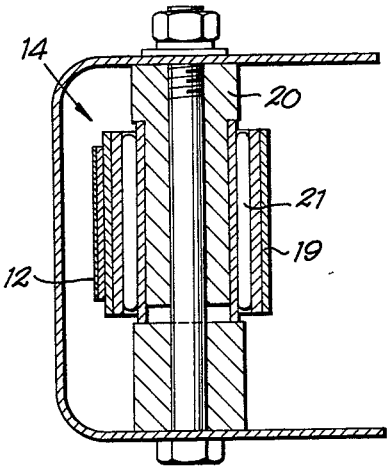

Gear 8 engages a perforated rod or lance 16 (FIG. 2) which is guided by guiding devices 17 and 18. This rod or lance 16 may for instance by fabricated from a strip of flexible plastic, which in itself is well known.

The above-mentioned fixed posts 13 and 14 may each consist of a sleeve 19 fitted around a pivot 20 with interposition of a rubber bushing 21. The latter permits a slight rotation of sleeve 19 due to which no too great stresses occur in the belt or chain 12 during the displacements of rocker lever 7.

The driving device thus described is therefore extremely simple and takes up very little space. With respect to known driving devices with the same purpose, it offers the advantage of slight weight, and consequently of low inertia, and such notwithstanding a ratio between input and output movements of more than 1 to 10.

It is obvious, that various alterations can be applied to the form of embodiment described as example, without going beyond the scope of the invention.

The invention also extends to weaving looms which are equipped with at least one driving device as described above, or respectively as defined in the following claims.

What I claim is:

1. Mechanical multiplier for weaving looms, characterized by the combination of: a pivotally mounted driven rocker lever; a gear which meshes with the part to be driven; a pinion fixedly attached to said gear; and a flexible elongated element trained over said pinion and, guided over two rollers .ournalled on one end of said rocker lever remote from its pivot mounting and both ends of which are attached to fixed points of the device.

2. Device according to claim 1, characterized by the fact that said rocker lever, gear and pinion are rotatably mounted upon a common shaft.

3. Device according to claim 2, whereby the multiplier is used for the driving of rods, characterized by the fact that said common shaft is fitted in a housing which is attached to the slay of a weaving loom.

4. Weaving loom equipped with at least one multiplier as defined in claim 1.

* * * * *